United States Patent [19]

Meffert et al.

[11] Patent Number: 4,863,523

[45] Date of Patent: Sep. 5, 1989

[54] PROCESS FOR CLEANING SOILED SOLID MOLDED ARTICLES

[75] Inventors: Alfred Meffert, Monheim; Andreas Syldatk; Johann F. Fues, both of Duesseldorf, all of Fed. Rep. of Germany

[73] Assignee: Henkel Kommanditgesellschaft auf Aktien, Duesseldorf, Fed. Rep. of Germany

[21] Appl. No.: 34,823

[22] Filed: Apr. 3, 1987

[30] Foreign Application Priority Data

Apr. 5, 1986 [DE] Fed. Rep. of Germany ..... 3611422

[51] Int. Cl.[4] ..... B08B 3/12

[52] U.S. Cl. ..... 134/1; 134/7; 134/10; 134/13

[58] Field of Search ..... 134/1, 6, 10, 40, 2, 134/7, 13

[56] References Cited

U.S. PATENT DOCUMENTS

| | | | |
|---|---|---|---|
| 3,472,840 | 10/1969 | Stone et al. | 260/231 |
| 3,589,978 | 6/1971 | Kamal et al. | 162/158 |
| 3,632,559 | 1/1971 | Matter et al. | 260/78 |
| 3,864,317 | 2/1975 | Ogata et al. | 260/79 |
| 3,886,075 | 5/1975 | Bernardino | 252/8.75 |
| 3,910,862 | 10/1975 | Barabas et al. | 260/79 |
| 3,912,808 | 10/1975 | Sokol | 424/71 |
| 3,952,128 | 4/1976 | Ogata et al. | 428/265 |
| 3,958,059 | 5/1976 | Diehl | 428/260 |
| 3,993,573 | 11/1976 | Gloss | 252/89 R |
| 4,157,388 | 6/1979 | Christiansen | 424/70 |
| 4,240,450 | 12/1980 | Grollier et al. | 132/7 |
| 4,272,386 | 6/1981 | Draper, Jr. et al. | 252/8.6 |
| 4,272,515 | 6/1981 | Hofman et al. | 424/70 |
| 4,292,212 | 9/1981 | Melby | 252/547 |
| 4,534,892 | 8/1985 | Suzuki et al. | 252/545 |
| 4,710,232 | 12/1987 | Tahbaz | 134/1 |

FOREIGN PATENT DOCUMENTS

| | | |
|---|---|---|
| 0153146 | 8/1985 | European Pat. Off. . |
| 3339048 | 9/1985 | Fed. Rep. of Germany . |
| 1136842 | 12/1968 | United Kingdom . |
| 1405785 | 10/1975 | United Kingdom . |

OTHER PUBLICATIONS

R. Sievers, *Metall,* Intl Zeitschrift fuer Technik & Wirtschaft, vol. 35, pp. 763 ff.

Kirk-Othmer, *Encyclopedia* of Chemical Technology, 3rd Ed., Wiley-Interscience (1983), vol. 23, pp. 462-479.

Seifen-Oele-Fette-Wachse, pp. 529-532, 612-614.

Chemical Abstracts 101:173491t.

Hawley, G. G., ed., *The Condensed Chemical Dictionary,* 9th ed., Van Nostrand Reinhold Company, N.Y., ©1977 pp. 738-739 and 262.

*Primary Examiner*—Patrick P. Garvin
*Assistant Examiner*—George R. Fourson
*Attorney, Agent, or Firm*—Ernest G. Szoke; Wayne C. Jaeschke; Real J. Grandmaison

[57] ABSTRACT

A process for cleaning a soiled solid molded article in an aqueous detergent wash bath in the presence of ultrasound whereby pigmented and/or fatty soils are loosened from the soiled article. The wash bath is contacted with a soil-collecting polyfunctional quaternary ammonium compound which is at least substantially insoluble and/or is fixed to a solid which is substantially insoluble in the wash bath to collect from the wash bath at least a portion of the soils loosened from the article.

25 Claims, No Drawings

PROCESS FOR CLEANING SOILED SOLID MOLDED ARTICLES

BACKGROUND OF THE INVENTION

1. Field of the Invention

This invention relates to improvements in the cleaning of solid materials or molded articles by treating them in a washing or cleaning bath under simultaneous action of ultrasound on the bath liquid and/or the material to be cleaned.

2. Discussion of Related Art

The elimination especially of pigmented and/or fatty soils from the surface of solid workpieces or molded articles in laundering and cleaning baths with simultaneous use of ultrasound for easier soil removal today is a definite part of the relevant process technology, wherein the total area, from an occasional cleaning process, for example, in the cleaning of ancient coins, to an independent process step in the continuous industrial scale manufacture, for example, of motor vehicles, is covered. A considerable body of literature exists concerning the mathematical laws, the units and the application areas of ultrasound cleaning technology, wherein the following may be mentioned as fairly recent publications: R. Sievers, Facilities and Application Areas of Ultrasonic Cleaning Technology, in: Metall, Internationale Zeitschrift für Technik und Wirtschaft, Vol. 35, pp. 763 ff, 1981; and Kirk-Othmer, Encyclopedia of Chemical Technology, Third Edition, Wiley-Interscience (1983), Vol. 23, pp. 462–479, especially 463–465.

Thus, the most important process elements even today include the following conditions; i.e., a frequency range of about 20–60 kHz, the use of chiefly piezoceramic and magnetostrictive oscillators, power densities in the sound-struck area in the range from about 5–15 W/l with some considerable deviations, mainly higher, and the use of aqueous, and especially aqueous-surfactant baths and/or organic solvents as the wash liquid. Chlorinated or fluorinated hydrocarbons (CHC or FHC) are mainly used as the organic solvents.

The facilitation of the cleaning effect is essentially based on cavitation and the extreme pressure fluctuations produced in this way in the immediate vicinity of the soiled solid surface. It is known that cavitation in aqueous cleaning solutions is harder and more effective than in organic solvent systems. Because of the extremely different types of soils, however, according to the existing technical possibilities, either aqueous and/or organic wash baths are used, depending on the soil. Organic solvents are especially suitable for degreasing, but not infrequently leave behind the degreased, pigment-like residues as a dry, dusty coating on the surface to be cleaned. Aqueous, especially alkaline, and possibly surfactant-containing wash baths are not very suitable for removal of fatty soils, but instead are suitable for removing pigment-like soils, or, at best, for removing readily emulsificable fatty coatings or residues on the solid surface.

It is true for both the aqueous and the organic washing and cleaning systems that the liquid phase rapidly becomes enriched with the washed-off soil in the case of continuous use, rapidly reaching a soil concentration which once again results in soil residues depositing on the surfaces to be cleaned, and thus inadequate cleaning performance. Especially in a continuous process, the constant replacement of the washing bath liquid phase by fresh bath liquid is necessary. This can be done batchwise or continuously in the units known to date. In general, regeneration of the soil-loaded liquid phase is provided. This is especially true for organic wash liquors, which are generally purified by distillation and returned to the cleaning process. However, the regeneration of aqueous wash bath liquids often requires such a considerable expense that instead the used bath liquid is discarded and replaced by freshly made up aqueous bath liquid.

The teaching of this invention proceeds from the object of substantially improving in many ways the cleaning of molded articles, and especially the cleaning of the surfaces of such molded articles from pigmented and/or fatty soils in suitable washing and cleaning baths with the simultaneous use of ultrasound. Thus, for example, the invention also seeks to enable the batchwise or continuous regeneration of the bath liquids, and precisely during the use of these baths, without distillation of the bath liquid being required. The advantages of the new development thus apply equally to organic bath liquids and to aqueous baths, wherein the invention in a particularly important embodiment has also taken on the task of partly or preferably completely avoiding organic wash baths, and especially in such instances where previously the use of chlorinated hydrocarbons and/or fluorinated hydrocarbons was considered indispensable. An additional object of the invention is that of cleaning effectively with aqueous bath liquids under relatively mild working conditions especially in terms of the pH value and the process temperature, wherein even the most difficult cleaning task should be possible in aqueous washing and cleaning baths using ultrasound in the neutral pH range and, at most, at moderately elevated temperatures. Finally, in a particular embodiment, the invention permits the removal of the soil from a bath liquid in such a way that it is possible essentially to operate with stationary baths by batchwise or continuous throughput of molded articles to be cleaned, without exhaustion of the cleaning capacity of the wash baths used taking place. Further specific objects of the invention will become apparent from the description of the invention which follows.

DESCRIPTION OF THE INVENTION

Other than in the operating examples, or where otherwise indicated, all numbers expressing quantities of ingredients or reaction conditions used herin are to be understood as modified in all instances by the term "about".

According to a first embodiment, this invention comprises a process for cleaning the surface of solid molded workpieces or molded articles, especially from pigmented and/or fatty soils, by treating them in a washing and cleaning bath under the at least partial action of ultrasound, if desired in conjunction with additional washing and/or rinsing steps without ultrasound exposure, wherein the improvement of the process lies in the fact that washing and cleaning baths are used for ultrasound treatment which are characterized by the presence in the bath liquid of at least substantially insoluble soil collectors for removing therefrom at least part of the loosened soil. Insoluble soil collectors are preferably used, which can be separated manually and/or mechanically from the cleaned molded article parts. In an especially important embodiment of the invention, the insoluble soil collectors are used in such a form that they can also be removed manually and/or mechanically from the liquid phase of the washing or cleaning bath. The insoluble soil collectors, existing as solids, are preferably designed such that under the cleaning conditions and especially under the action of ultrasound as well, they prevent substantial retransfer of the removed soil particles to the solid surface to be cleaned.

In a particularly preferred embodiment of the invention, in the step of cleaning using ultrasound, aqueous washing or cleaning baths are used which contain at least partially dissolved surfactant components. In this preferred embodiment of the invention, aqueous surfactant baths containing pigmented or fatty soils to be removed, as well as the soil collectors simultaneously used which are undissolved in the wash bath, are adapted to one another in such a way that the total quantity of pigmented and/or fatty soil removed, or at least most of it, is taken up by the insoluble soil collector, and can be ejected from the cleaning bath by removal of the insoluble soil collector phase from the wash bath liquid. This removal of the soil collector can take place either batchwise, e.g., intermittently, or continuously. It can be performed in this way either during operation of the bath, carried out during a break in operation, or on liquid phase withdrawn from the bath. Details of this operation will become apparent from the following.

The focal point of the teaching in accordance with this invention lies in the following discussion. The process in accordance with the invention, with the aid of the cleaning forces produced by ultrasound, loosens the soil contaminants from the surface of the material to be cleaned, but does not stop at this working step. Simultaneously in the process in accordance with the invention, a soil collector in solid form which is insoluble in the wash bath is provided, whereby on the surface of which the soil at least partially precipitates or is collected thereby. Correspondingly, in the process of the invention, transfer of the soil from a soil releasing solid surface to a soil collecting, separately provided solid surface takes place. The wash bath liquid now essentially serves only for the formation of cavitation and thus for facilitating cleaning by the effect of ultrasound, as well as for transporting the removed soil particles to the surface of the soil collector existing in a separate solid phase. The wash bath liquid itself is not consumed in this process. It is regenerated directly to the extent to which the soil fractions taken up by it are collected by the soil collector.

Pigmented soils and/or fatty soils are especially to be expected in, or to be removed as impurities from, a wash bath. The collector systems used in accordance with the invention are tailored to these considerations. They can consist of only a single substance which is capable of binding both pigmented soil and fatty soil. In particular, however, different collector systems can be used, which on one hand are more suitable for binding pigmented soil, and on the other hand are more suitable for binding fatty soil. The corresponding soil collector solids can be used in a mixture; however, they may also be used separately in sucessive treatment steps. It is particularly important pursuant to the teaching of the invention that under these conditions of soil transfer from one solid surface to another surface with the simultaneous regeneration of the wash liquid, that the use of aqueous systems is possible, regardless of whether the removal of pigmented soils or fatty soils is involved. The process in accordance with the invention employs the more extensive knowledge available on laundering or cleaning with aqueous surfactant baths, both from the area of industrial cleaning and from the area of textile laundering. The soil collector systems used in accordance with the invention in particular are designed such that they contain the soil collectors immobilized at least on the surface of an insoluble collection system. In this process in particular, it is also possible to use the collector systems in accordance with the invention directly in the washing or cleaning bath and under the effect of ultrasound, without retransfer of the soil removed from the soil collector to the material to be cleaned as a result. The teaching in accordance with the invention thus expands the application of a working principle to the area of cleaning, especially industrial cleaning, of solid molded articles under the influence of ultrasound, which in a number of earlier applications by the applicant was preferentially described for the laundering of textile materials under conventional laundering conditions for this purpose. Reference therefor is made to the earlier German patent application Nos. 35 45 990.5, 36 05 716.9, and 36 06 729.6. The application of this new working principle to the area of textile laundering using ultrasound especially for easier removal of pigmented and/or fatty soils is described in the earlier German patent application No. 36 10 386.1. The disclosure of all these mentioned earlier patent applications is thus also expressly made part of the subject of the present disclosure.

For the process of cleaning molded articles provided in accordance with the invention, especially industrial cleaning under the influence of ultrasound, the invention provides as an essential element the simultaneous use of so-called soil collectors for taking up at least part of the removed pigmented and/or fatty soil. These collectors as such are insoluble in the wash bath and exist in such a form that they can be removed manually and/or mechanically from the cleaned material, and if desired, separated from the wash bath employed.

A first and, in accordance with the invention, particularly important class of such collector substances comprises polyfunctional quaternary ammonium compounds (PQUATs), insoluble and/or immobilized on appropriate insoluble solid supports, especially used in the form of their insoluble or immobilized PQUAT-surfactant complexes, and specifically described in the afore-mentioned earlier applications, especially German patent application Nos. 36 06 729.6 and 36 10 386.1.

The subject of the earlier German patent application No. 35 45 990.5 is the use of polyfunctional quaternary ammonium compounds (PQUATs) which are insoluble in aqueous-surfactant laundering and cleaning solutions even under the temperature loads of the laundering process, and/or are immobilized on solids insoluble in these aqueous solutions in such a form that they cannot be washed off, as particulate soil-collecting cleaning enhancers in aqueous-surfactant laundering and cleaning solutions, which can be removed manually and/or mechanically following the laundering or cleaning of the material to be cleaned. At least a considerable fraction of the soil, especially pigmented soil, solubilized in textile laundering is taken up by the PQUATs present in a solid phase, and thus finally transferred from the textile material, originally soiled and to be cleaned, to the soil collector.

The teaching of the earlier German patent application No. 36 05 716.9 modifies the use of such PQUATs which are insoluble in aqueous laundering and cleaning solutions and/or are present in immobilized form on solids appropriately insoluble in these aqueous solutions in such a way that the new PQUAT-containing auxiliaries are used for at least partial regeneration of soil-loaded cleaning baths, especially for their subsequent reuse. In accordance with the teaching of this proprietary disclosure, especially aqueous-alkaline, if desired surfactant-containing cleaning baths, particularly wash solutions from textile laundering, can be subjected to regeneration in such a way that either during the textile laundering and/or following it, the soiled cleaning bath is treated with the insoluble or immobilized PQUAT and thus at least partially freed from solubilized soil, especially pigmented soil. The wash solution treated in this way can be submitted for reuse, for example, within the framework of textile laundering.

The use of corresponding PQUATs or PQUAT-surfactant complexes formed from the reaction of PQUATs with surfactant components, especially anionic, amphoteric and/or nonionic surface active agents, as soil-absorbing concentration-reduction agents for lowering the demand for conventional chemicals in laundering and/or cleaning agents forms the subject of German patent application No. 36 06 729.6.

The following general statements in the earlier referenced applications on the PQUATs to be used or the PQUAT-surfactant complexes resulting from them, which are particularly to be understood as examples, are also applicable for the teaching of the present invention.

Polyfunctional quaternary ammonium compounds (PQUATs) are described and known in the documented state of the art, and are also commercially available in many forms. One important area of application for such compounds is in the area of cosmetic preparations, especially for treating or conditioning the hair. One of the known characteristics of PQUATs is that they are capable of being absorbed on solid surfaces, in particular even in the presence of standard surfactant components. The ability of PQUATs to be absorbed and to remain absorbed on solid surfaces differs according to their composition. The particular composition of the PQUATs plays a crucial role in this regard. However, for the behavior of the PQUATs under the influence of aqueous surfactant baths, the interaction especially with anionic surfactant components may be of determining significance here. In the case of stoichiometric or approximately stoichiometric amounts of the anionic surfactant components, the corresponding anionic surfactant salt usually forms on the quaternary ammonium group. Such PQUAT-anionic surfactant salts generally show a greatly reduced water solubility. Corresponding precipitates form, see for example German Preliminary Published Application No. 2 242 914. Such anionic surfactant salts of PQUATs have been suggested as antistatic agents for application to fibers. However, it is also known in this regard that as a result of considerable excessive amounts of the anionic surfactant, a redissolution of the initially precipitated PQUAT-anionic surfactant salt can occur, see in this regard the publication in Seifen-Öle-Fette-Wachse, pp. 529 to 532 and 612 to 614, 1985. Especially in the reaction diagram on p. 530 of this citation, the formation of solubilized micelle systems of the anionic surfactant-PQUAT complex in the presence of an excess of the anionic surfactant is shown.

In general, these previously known PQUATs are oligomers and/or polymers which have a majority of plurality of quaternary ammonium groups on their oligomeric or polyeric matrix. In general, adequate water solubility of a PQUAT is required for use in cosmetics. By contrast, the use of PQUATs in accordance with this invention presupposes the insolubility of the PQUAT-based detergency enhancers used as soil collectors in aqueous-surfactant laundry or cleaning solutions. The insolubility of the PQUAT components used as soil collectors in accordance with this invention is actually an absolute prerequisite especially for the area of textile laundering. If this critical condition in accordance with the invention is not met, the desired laundering result is adversely affected. Soluble PQUAT fractions entering the wash bath are attracted to the textile material to be washed, and bind additional pigment soil quantities thereto.

Nevertheless, in an important embodiment of the invention, it is possible to use all previously known originally water soluble PQUAT components for the application in accordance with this invention. For this purpose it is only necessary to convert the inherently water-soluble and/or water-swellable PQUAT components of the prior art into the desired insoluble form, or to fix them on appropriate water-insoluble carriers and immobilize them in such a way that they cannot be washed off from the carrier during the cleaning process.

Suitablel polyfunctional quaternary ammonium compounds that may be employed in this invention include those mentioned, for example, in U.S. Pat. Nos. 3,589,978, 3,632,559, 3,910,862, 4,157,388, 4,240,450 and 4,292,212; Great Britain Pat. No. 1,136,842; German Published Application No. 27 27 255 and U.S. Pat. No. 3,472,840 cited therein.

Suitable originally water-soluble or water-insoluble PQUATs in accordance with this invention preferably have an average molecular weight of at least about 200, preferably at least about 300 and more preferably of at least 1000. The upper limit of the average molecular weight of the PQUATs is basically meaningless and may be, for example, up to 10 million or at even far higher values. This is clear from the water insolubility requirement which the PQUATs have to satisfy in accordance with the invention. If this is assured, no upper limts are set on the molecular weight.

After suitable preparation, for the purposes of the invention, which will be described in more detail hereinafter, suitable PQUATs, initially water soluble but subsequently immobilized on an insoluble carrier, include all polymers which have quaternary ammonium groups either in the polymer chain or attached to the polymer chain. Such quaternary ammonium groups can also be derived from cyclically bonded nitrogen. Examples of such quaternary ammonium groups include corresponding members of 5- or 6-membered ring systems, e.g., morpholine, piperidine, piperazine or indazole rings. Numerous examples of such water-soluble PQUATs are described in greater detail, for example, in U.S. Pat. No. 4,240,450.

Homopolymers on copolymers containing cyclic units of the type described in U.S. Pat. No. 3,912,808 are particularly suitable herein. For example, polymers sold under the tradename Merquat®100, and under the tradename Marquat®550 (Quaternium 41) have this structure.

Other particularly suitable PQUATs include, for example, cellulose ethers wherein the anhydroglucose units each contain from 1 to 3 substituents containing quaternary ammonium groups attached via ether oxygen. Polymers such as these are known, for example, from U.S. Pat. No. 3,472,840. A commercial product having this structure is, for example, Polymer-JR ®400.

Other particularly suitable cationic polymers include, for example, the quaternary polyvinylpyrrolidone copolymers disclosed in U.S. Pat. No. 3,910,862 and commercially available, for example, under the tradename Gafquat ®734 and 755, and the quaternary polymeric urea derivatives disclosed in U.S. Pat. No. 4,157,388, and available, for example, under the tradename Mirapol ®A 15. Other suitable copolymers with polycationic characteristics include the polyacrylamide copolymers described in European patent application No. 0,153,146, laid open for public inspection, which in particular in addition to 50 mol-% acrylamide units contain up to 50 mol-% of a quaternized aminoalkyl ester of acrylic acid or methacrylic acid. These copolymers are water-soluble. They are applied therein to cloths based on cellulose fibers and become attached thereto on the basis of their natural attractive capacity. Cloths of this type can be washed out and are then to be used, together with anionic surfactant-free surfactant systems, for cleaning hard surfaces, especially for glass cleaning. Under these conditions they are characterized by an increased soil uptake capacity. However, the cleaning cloths mentioned in the document are unsuitable for the use in customary surfactant laundry and detergent baths intended in accordance with this invention, which may also be exposed to temperature loads of up to about 95° C. Considerable portions of the numerous PQUAT copolymers described in the document are released into the wash bath, are attracted to the material to be cleaned, and lead to increased pigment soil contamination there. Only the conversion of such PQUATs into the physical state that will be mentioned below in accordance with this invention can convert them to cleaning enhancers in accordance with this invention.

Preferred PQUATs in accordance with this invention are those compounds which, in solid form, are difficult to dissolve in water. Cationic polymers such as these are, more preferably, the polygalactomannan derivatives known, for example, from Great Britain Pat. No. 1,136,842. Galactomannans are polysaccharides which occur in the endosperm cells of many leguminosae seeds, but that are only obtained on an industrial scale from locust bean gum, guar gum and tara gum. They are made up of a linear mannan main chain, consisting of mannopyranose building blocks which are attached by B-(1,4)-glycoside bonds and to which individual galactopyranose residues are fixed a sbranches by α-(1,6)-glycoside bonds. The individual polygalactomannans differ from one another primarily in their mannose-galactose ratio. The cationic derivatives of the polygalactomannans are prepared by reacting hydroxyl groups of the polysaccharide with reactive quaternary ammonium compounds. Suitable reactive quaternary ammonium compounds include, for example, those of the following general formula:

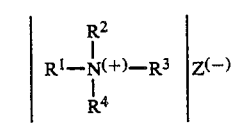

wherein $R^1$, $R^2$ and $R^3$ represent, for example, methyl or ethyl groups, and $R^4$ represents an epoxyalkyl group corresponding to the formula

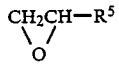

or a halohydrin group of the formula

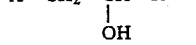

Wherein $R^5$ *l is an alkylene group with* 1–3 carbon atoms, X is chlorine or bromine, and Z is an anion, such as, for example chloride, bromide, iodide or hydrogen sulfate. The degree of substitution should be at least about 0.01 and preferably at least about 0.05, and typically falls between about 0.05 and about 0.5. A particularly suitable quaternary ammonium derivative of a polygalactomannan is, for example, guar-hydroxypropyltrimethylammonium chloride, which contains cationic groups of the formula $$-CH_2-CH(OH)-CH_2-N^{(+)}-(CH_3)_3]Cl^{(-)}$$

bonded to the oxygen atoms of the hydroxyl groups of the polysaccharide. Such cationic guar derivatives are marketed, for example, under the tradename of "Cosmedia Guar C 261". The degree of substitution (DS) of Cosmedia Guar C 261 is about 0.07. The commercial products "Jaguar C-13" (DS=0.11–0.13) and "Jaguar C 13 S" (DS=0.13) also belong to this type.

Suitable soil collectors for the cleaning stage described in accordance with the invention using ultrasound include, for example, corresponding PQUAT-surfactant complexes derived from the reaction of such PQUAT components with one or more surfactants, specifically anionic surfactants, amphoteric surfactants and/or nonionic surfactants. In this reaction, the counter-ion of the PQUATs originally present may be at least partly replaced by a surface active agent. In this process it may be preferably to use appropriate reaction products between original PQUATs and a surface active agent in which at least 50 equivalent percent and especially at least about 80 equivalent percent of the quaternary ammonium groups with respect to their counter-ion have been activated by exchange with the surface-active agent. In a preferred embodiment of the invention, the activation of the quaternary ammonium groups is performed by the use of at least equivalent amounts of PQUAT on one hand and surface-active agent on the other hand in the preparation step of the soil-absorbing collector. Excess amounts of the surface-active agent are generally not harmful and may even be preferred. Thus, particularly active collectors have been obtained by using a several fold excess of the surfactant component over the stoichiometrically required amount. This excess can, for example, amount to as much as 10 times the stoichiometrically calculated amount or even more, and for example can amount to as much as 1000 times this amount. In a particularly interesting embodiment, surfactants were used in 10 to 500 fold quantities based on the stoichiometrically required quantity.

Surfactant components capable of such an exchange are particularly useful as surface-active agents. It is known that in quaternary ammonium groups, depending on the type of quaternization reaction, a halide or a lower alkyl sulfate group is usually present as the counter-ion. In accordance with this invention, this counter-ion is replaced, for example, by an anionic group-containing surfactant or a correspondingly reacting surfactant. Thus the counter-ion can be replaced by known anionic, amphoteric and/or nonionic surface-active agents, especially by corresponding low molecular weight compounds having a surfactant character. It is known that PQUAT components are accessible to such a reaction especially with anionic surfactants, thus forming precipitation products having a reduced solubility. The invention makes use of this known reaction, since it has been found that particularly active soil absorbers are provided when this reaction has taken place with a surfactant component even before the use of the soil collecting absorber in the laundering or cleaning solution.

Insofar as the solubility of such PQUAT-surfactant complexes has not yet been adequately reduced, so that it is necessary to anticipate retransfer of these complexes to the material to be cleaned, the desired insoluble state of these impregnated composites can be achieved by cross-linking the PQUAT-containing impregnated composites, for example, by means of polyfunctional cross-linking components, in a known manner.

The insoluble PQUAT-based collectors, as described in detail in the earlier-filed applications, can be used in the form of flat supports with large surface areas, e.g., in sheet or film form, or also in the form of a simultaneously used cloth. In particular, however, in accordance with the invention it is preferred that these essential aids be used in the form of finely divided materials, which can be finely divided in dispersed form in the laundering and cleaning baths and thus assures that in the case of the most homogeneous possible distribution of the soil absorbing collector components, every soiled area of the article to be cleaned is surrounded by collector substance. In this way, the transport path of a removed soil particle from its original location to the desired deposition site on the collector surface is kept as short as possible. As a result of the movement and thorough mixing of the cleaning liquid, new adsorption-ready PQUAT areas can constantly be made available to the surface of the molded article to be freed from pigmented soil. The agitation of the overall bath with adequate flotation capacity of the very finely-divided collector material may be sufficient, but an additional movement of the bath liquid may also be provided.

The states of affairs described here pertain to the embodiment in which the surfaces to be cleaned under the influence of ultrasound are kept in continuous, direct contact with the soil collector. In an additional embodiment, also to be described in the following, however, it is possible to perform the cleaning process under the influence of ultrasound in the absence of fine, particulate, substantially insoluble soil collectors, instead first taking up the soil fraction loosened under the influence of ultrasound in the bath, and conducting this bath, batchwise, e.g., intermittently, or continuously, over separately stored or held soil collectors, in order in this way to free the bath from soil, and then preferably subsequently returning the cleaning bath, thus refreshed, to the cleaning process.

The PQUAT-based collectors existing as a heterogeneous solid phase in accordance with the invention especially absorb from the soil-laden bath electrostatically charged fractions, for example correspondingly negatively charged particulate soil. In addition, the PQUAT solid material can also act in a cleaning or bath-relieving way in terms of other soil fractions on the basis of other surface forces. In particular, the PQUAT-based collectors are also capable of removing considerable amounts of fatty soil from the bath. To intensify the cleaning action, however, precisely in this connection it may be advantageous also to use other material classes as soil-absorbing collectors in the sense of the invention, or to use them together with the PQUAT-based collectors.

Thus, in one important embodiment of the invention, an auxiliary is also used in a heterogeneous solid phase which is characterized by a high absorption capacity for oleophilic soil. It is known that particular plastics, for example polyethylene, polypropylene or polyurethane, or insoluble solids of any desired origin provided with a highly hydrophobic surface finish, have the ability to attract an oleophilic soil fraction made hydrophilic by the influence of a surfactant from a surfactant wash bath to themselves and retain it on their surfaces. Precisely in the area of industrial surface cleaning of solid molded articles, the binding of considerable amounts of fatty soil may be an important task. Up to the present time, organic solvent of the chlorinated and/or fluorinated hydrocarbon type have been used for this purpose. These solvents act as dissolvers for the fatty soil and, in processes known up to the present time, must be rapidly subjected to conventional distillative workup in order to maintain the cleaning action of the sound-exposed bath. On the other hand, it is well known by the expert that fatty soils can also be loosened by surfactant-containing, aqueous wash baths, and taken up in the bath. In the preferred embodiment of this invention in which aqueous laundering and cleaning liquids are used, this working principle is utilized. Then, insoluble soil collectors of the type described herein are used to withdraw the fatty soil from the aqueous-surfactant bath loaded with fatty soil.

In an important embodiment of the invention, the total soil collector system can be based on such predominantly oleophilic soil-binding systems. This becomes possible when the contaminants to be removed from the solid molded articles are exclusively or predominantly fatty soils. Since this prerequisite is fairly seldom fulfilled precisely in the industrial area, and in addition, as a rule, pigmented soils must be anticipated, in the more important embodiment of the invention, together with such oleophilic collectors, a collector substrate based on PQUAT or a PQUAT-surfactant complex is at least partially used.

The collectors for oleophilic soil can be used, for example, in the form of flakes, fibers or fiber structures such as cloths, random fiber webs, poromer sheets and the like. Here, too, it is true that they can be used directly in the cleaning bath in contact with the solid surface to be cleaned, and/or that holding them separate from the cleaning process is possible in the case of batchwise or continuous passage of the cleaning bath to take up the oleophilic soil. In any case, it is required in accordance with the invention with respect to the soil collectors, that a manual and/or mechanical separation between the material to be cleaned and the soil collectors is ensured, and especially also between the liquid phase and the soil collector.

The use of the oleophilic soil collecting auxiliaries can be performed simultaneously with the treatment of the cleaning bath with the PQUAT-based collectors and/or separately from this. The specific working conditions are determined by the nature of the soil in the cleaning bath and the anticipated loading of the soil collecting auxiliary in the solid phase.

The insoluble PQUAT-based collectors used as soil absorbing, concentration reducing agents in accordance with the invention are preferably used as a finely divided solid which is dispersed in the wash bath during the laundering process, is removed from the washed material after the completion of the laundering process, and if desired, can also be finally separated from the purified wash liquor, as is described in detail in the above-mentioned earlier German patent applicaton No. 36 05 716.9.

Any suitable insoluble material, inorganic and/or organic in nature, may be employed as an insoluble carrier material for the fixation of a PQUAT or PQUAT-surfactant complex thereto and thus for the immobilization of these soil-collecting active components, assuming that they otherwise show inert behavior in the wash solution. For example, suitable organic support materials may be of vegetable origin.

However, preference is given to inorganic supports, as are described in detail in the earlier applications mentioned. These are mineral substances of natural and/or synthetic origin, which are present in the form of finely divided solids. Preferably in accordance with the invention PQUAT-coated support substances with a specific surface of at least 0.5 $m^2/g$ are used, wherein in particular this specific surface preferably amounts to at least 1 $m^2/g$. Specific surface is defined as the surface area that can be coated with PQUAT. Certain mineral substances particularly suitable for this purpose also have surface areas in the interior of the solid base, either due to their pore structure or due to their swellability, although these are not accessible to coverage with PQUAT or only to a limited extent. However, the outer surface capable of being covered can reach considerable values, which can reach or exceed 10 $m^2/g$ or even 50 $m^2/g$ and extends into the range of 100 $m^2/g$ or even higher, up to for example 300 $m^2/g$. Colloidal silicas are examples of such extreme surface areas accessible to coverage with PQUATs.

The maximum particle size of the PQUAT-loaded very fine particles preferably has a value not exceeding about 100$\mu$, preferably not exceeding about 40$\mu$; these numerical values are based on the absolute particle diameters and mean that all or at least the great majority of the existing solid particles fulfill these general parameter conditions. Particles which have an average particle size (volume average) amounting to a maximum of about 10$\mu$ can be particularly advantageous for effective cleaning, wherein the absolute particle size of at least the predominant portion of all solid particles falls below this value.

Suitable inorganic supports especially include insoluble and finely divided particulate salts, oxides, silicates and the like. Especially suitable, for example, are aluminosilicates of the type of the zeolites or zeolite-like compounds, especially sodium zeolite A, used to a great extent in detergents today. Instead, however, zeolite A may also be used in the exchanged form, for example as a calcium salt.

A particularly suitable mineral support class includes swellable, very finely divided materials of the type of clays and/or the swellable layer silicates, especially from the smectite class. Swellable inorganic minerals of this type are characterized by a particularly large surface area in the swollen state. Especially suitable here are the known smectite clays such as montmorillonite, hectorite nd/or saponite. However, also suitable are comparable synthetic materials, especially also appropriate synthetic materials with only limited swellability, as are described for example in the earlier filed German patent application No. 35 26 405.5.

When working with collectors which contain an insoluble active component, for example, the PQUAT-surfactant complex and/or a highly oleophilic coating as a surface finish on inherently inert insoluble solids, in accordance with the invention it may be preferred to provide these active surface finishes in the thinnest possible layer on the insoluble solid carriers. In this way, optimal utilization of the soil collecting active ingredients is ensured. In this connection, for example, it may be preferable to employ layer thicknesses of PQUAT or PQUAT-surfactant complexes on insoluble supports which do not exceed, or do not substantially exceed, the range of about 100$\mu$. In a preferred embodiment of the invention, however, far lower layer thicknesses of such immobilized PQUAT collectors are provided. Working with finely-divided, layered supports, for example, based on a mineral, having a high specific surface, the thickness of the PQUAT-containing coating can extend into the region of monomolecular layers. Preferably, corresponding layer thicknesses of the active layer substance can be used on the carrier materials in the range up to about 1$\mu$ or less.

In the process in accordance with the invention it is possible to work effectively with baths in which the capacity of the insoluble soil collectors for soil immobilization on the collectors is already largely exhausted, but not completely expended. This embodiment is especially important for a continuous cleaning process in which stationary sound treated baths are used, the insoluble collector phase of which is regenerated batchwise or continuously, while the material to be cleaned is likewise conveyed batchwise or continuously through the sound-treated cleaning step. Here, for example, the cleaning can take place in such a way that the bath liquid together with the soil-loaded collector is circulated over a separation step in which at least part of the soil-loaded collector is removed, while free collector capacity is returned to the bath. In the other previously mentioned embodiment it is possible to follow a procedure wherein the surfaces to be cleaned are treated only with the wash solution under the influence of sound, and in this process the soil is first transferred to the wash solution, after which this wash solution is conveyed batchwise and/or continuously through a separately arranged bed of the soil collector, and at least partially regenerated therein. It is generally true, especially for continuous processes of the type mentioned here, that it is possible to work with collectors whose capacity for soil immobilization on the collectors is utilized to the extent of about 20 to about 98%, preferably no more than 95%, and especially in the range from about 50 to 90%.

The quantity of PQUAT or PQUAT-surfactant complex to be utilized simultaneously with the laundering agent may be adjusted to the anticipated soil loading. If only a one-time use of the soil absorber is intended, even very small amounts of these absorbers are sufficient to bind the pigmented soil usually encountered. However on an industrial scale, especially in a continuous cleaning process, relatively large amounts of pigmented and/or fatty soils to be removed are encountered. This state of affairs can be overcome by the total amount of collector used and/or by preferably partial ejection of contaminated collector fractions and corresponding introduction of fresh collector fractions. It is generally true that the collectors of the type involved here are capable of binding an equal quantity up to several times their weight of soil, especially pigmented and/or fatty soil, as a result of the spreading of the PQUAT-based collector in a very thin layer on the support.

If, within the scope of the invention, soil-absorbing collectors are used which contain, on an organic and/or inorganic insoluble support, an impregnation with PQUAT or PQUAT-surfactant complex or a corresponding hydrophobic finish for absorbing oleophilic soil, it may be preferable to keep the quantity of this impregnation, based on the total weight of the impregnated solid, in the range of from about 0.01 to 20%/wt., and especially in the range of from about 0.1 to 10%/wt., preferably in the range of about 0.1 to 1%/wt.

The use of the previously mentioned swellable layer silicates of the smectite group and especially the use of swellable very finely divided montmorillonite, hectorite or saponite can be modified as follows. To create the largest possible surface, suitable for the uptake of PQUAT-surfactant complex, it is advisable to pre-swell these swellable materials. This pre-swelling can be performed in a purely aqueous phase. However, in a special embodiment, the inner regions of the swellable materials can be formed such that they perform an additive function within the scope of the soil collectors in accordance with the invention. It is within the teaching of the invention in this embodiment to provide the swellable internal structure of these mineral materials with an oleophilic coating, and to finish layer silicates treated in this way with an additional very thin layer of PQUAT-surfactant complex on the outer surface. The oleophilically finished internal regions of this solid phase are then capable of drawing up oleophilic soil fractions loosened in the cleaning process and thus further enhancing the cleaning action of the chemicals. For oleophilic finishing of the inner areas of soil collectors swelled in this manner, for example, monoquaternary ammonium compounds are suitable, which have hydrocarbon groups of limited carbon numbers on the quaternary nitrogen atom, for example up to 18 and preferably up to 12 carbon atoms. In addition to or in place of the prior or subsequent coating of such layer silicates onto the PQUAT-surfactant complex, correspondingly finished layer silicates can also be used as mixing components together with the solids serving as pigmented soil collectors.

The temperature of the wash bath during the ultrasound treatment may be up to about 95° C., but is preferably considerably lower and usually does not exceed temperatures of about 80° C. Effective cleaning is possible at room temperature. Reduction of the process temperature toward room temperature is even preferred from the viewpoint of promoting the desired cavitation action. On the other hand, it is necessary to consider the fact that in the process in accordance with the invention, a certain interaction of conventional effects of cleaning with surfactants and the inherently known effect of ultrasonic cleaning exists. It has often proven advantgeous to carry out the washing step of the ultrasonic treatment in the temperature range of from about 30° to about 70° C., and especially in the temperature range of from about 35° to about 50° C.

The frequency range coming under consideration for performing the process in accordance with the invention involving the step of ultrasonic treatment includes the entire range known today and also partly utilized in the cleaning process. Particularly preferred frequencies of sound application fall in the range up to about 100 kHz, wherein the lower limit for the ultrasound is usually given as about 16 kHz. Correspondingly, a range of about 20 to 60 kHz can be especially suitable as the sound frequency used, wherein once again it is known here that the tendency for cavitation formation and thus to activation of the desired cleaning forces is greater, the lower the sound impingement frequency selected in the range mentioned here. The effects of far higher frequencies, e.g., into the MHz range, are also known; these are especially characterized by a greater material penetration capability or force, even if the tendency to promote cavitation development per se decreases here.

It may be advantageous to agitate the material being cleaned continuously and/or discontinuously in the wash bath during the sound treatment step. In this way not only are the disadvantages of any shadow regions eliminated, but the removal of pigmented soil in particular can be considerably accelerated.

The design of the sound exposure step in the process in accordance with the invention and of the devices suitable for carrying out this process step are generally influenced by a number of parameters. The following may be mentioned as examples: The composition and selection of the cleaning system, the size and degree of loading of the cleaning bath, the operating conditions of the cleaning bath, accessibility, stability and energy consumption of the sound-producing elements, as well as the anticipated degree of loading of the device in use, for example, in the sense of a practically continuous use in the area of continuous commercial cleaning, or only periodic use.

Finally, as a result of such considerations, in the design of the cleaning devices, it is determined to conduct the step of cleaning by ultrasound with a uniform frequency or with mixed frequencies and/or with sliding frequencies at continuous or pulsating sound exposure. For the power densities, values of up to about 50 $W/cm^2$, especially up to about 10 $W/cm^2$ and preferably values in the range from about 0.5 to 5 $W/cm^2$ have proven entirely usable and effective, wherein the power introduction into a bath can amount to, for example, in the range of at least about 20 W up to the kW range. Higher amounts are also suitable for larger baths.

Satisfactory washing results in the ultrasonic step are often obtained in a period of from 0.01 to 60 minutes, especially in 0.1 to 15 minutes, wherein a time interval from about 1 to 15 minutes, especially about 1 to 10 minutes generally provides the desired cleaning effect. Special cases of shorter treatment times are known to exist in especially the continuously cleaning of fast-moving articles, e.g., wires.

In addition, the cleaning process in accordance with the invention, and especially the accelerated and facilitated loosening of pigmented and/or fatty soils through the use of ultrasound are governed by the general rules for textile laundering, as described especially in the German patent application Nos. 36 06 729.6 and 36 10 386. The cleaning agent system for mastering the pigmented soil and/or fatty soil problem can be reduced to the suitable combination of the following two components: auxiliaries for loosening the soil contamination from the material to be cleaned, as well as soil-attracting, insoluble or immobilized collectors in the sense of the invention.

The auxiliaries for soil loosening and for transferring the loosened soil to the insoluble collectors are preferably surfactants. Their composition and quantity, however, is now no longer to be predicated upon the fact that these surfactants, used as laundering auxiliaries, also have decisive significance for solubilization of the dissolved pigmented soil in the bath. Specifically, the disclosures of the previously mentioned earlier filed German patent applications 36 06 729 and 36 10 386 are applicable here.

In the process in accordance with the invention, the cleaning step using ultrasound can be combined in a manner known in and of itself with additional working steps, for example a pre-cleaning, and/or one or more subsequent rinsing and/or drying steps. Thus the material cleaned with water can be dried especially in a known manner by subsequent treatment in a fluorinated hydrocarbon bath, saving energy and preventing spots, at a relatively low temperature. Reference is made in this connection, for example, to the initially cited published literature.

EXAMPLE

Cleaning experiments were performed on motor vehicle carburetor elements of complex design, which as a result of years of use in practical operation had become coated with a thick, tightly adhering oil-pigment soil. In this process, 3 such molded articles were treated in succession in the same bath with the aqueous bath described in the following under the influence of ultrasound. In each instance the articles were dipped about halfway into the bath liquid.

In the following, in the soiled bath, a polyester fabric base swatch provided with standard soil was exposed to the influence of ultrasound. The following conditions were employed:

1. Capacity of the cleaning vat: 4 l; ultrasound frequency transferred to the cleaning bath: 35 kHz.
2. Composition of the wash bath:
   0.5 g/l fatty alcohol ether sulfate (2 moles of ethylene oxide)—"Texapon N25",
   1 g/l $\alpha$-sulfo-$C_{16/18}$ fatty acid, disodium salt,
   0.6 g/l PQUAT-surfactant-coated layer silicate of the composition indicated in the following, 1.5 g/l hydrophobically treated silica, "Sipernat 50S". The PQUAT-surfactant-coated layer silicate, i.e., the insoluble support used in accordance with the invention, was made up as follows:

insoluble mineral material: swellable layer silicate, "Dis-Thix-extra"

PQUAT: Cosmedia Guar C261

Surfactant: Texapon N25

Layer silicate/PQUAT weight ratio: 20/1

PQUAT-coated layer silicate/surfactant weight ratio: 1/5

The aqueous bath containing the above listed components was prepared using tap water (16° dH).

3. Bath conditions:
   temperature: 48° C.
   pH value: 7 to 7.5
   sound impingement time per molded article treated: 20 minutes.

The carburetor molded pieces taken from the dark gray cleaning bath were washed with tap water and dried.

The immersed parts were found to be superficially cleaned. The non-immersed parts remained soiled.

The laundering test on polyester swatches in the soil-loaded bath went from an initial reflectance value of 29.5% to a laundry reflectance value of 80.0%. The laundered and rinsed test swatch was pure white.

We claim:

1. A process for cleaning the surface of a solid molded article containing pigmented or fatty soils comprising treating said article in a wash bath in the presence of at least the part-time action of ultrasound whereby said pigmented or fatty soils are loosened from said article, and collecting from said wash bath at least a portion of said soils loosened from said article by contacting said wash bath with a soil-collecting polyfunctional quaternary ammonium compound which is at least substantially insoluble or is fixed to a solid which is substantially insoluble in said wash bath, said solid comprising a particulate, finely-divided material having an average particle size of up to about 100 microns.

2. A process as in claim 1 including separating said soil-collecting polyfunctional quaternary ammonium compound from said article.

3. A process as in claim 1 including separating said soil-collecting polyfunctonal quaternary ammonium compound from said wash bath.

4. A process as in claim 1 wherein said wash bath comprises an aqueous bath containing a surfactant.

5. A process as in claim 1 wherein said wash bath comprises an aqueous bath having a pH value which is in the range between weakly acidic and mildly alkaline.

6. A process as in claim 1 including adding an insoluble polyfunctional quaternary ammonium compound-surfactant complex to said wash bath.

7. A process as in claim 1 including adding a heterogeneous solid having a high absorption capacity for oleophilic soil to said wash bath.

8. A process as in claim 1 wherein said wash bath contains a surfactant and said soil-collecting polyfunctional quaternary ammonium compound in an amount sufficient so that said soils loosened from said article will transfer to said soil-collecting compound without substantial retransfer back to said article.

9. A process as in claim 1 wherein said wash bath contains a nonionic surfactant and/or anionic surfactant dissolved therein.

10. A process as in claim 1 wherein said solid is a finely-divided solid selected from the group consisting of metal oxides, carbonates, silicates and aluminosilicates.

11. A process as in claim 1 wherein said soil-collecting polyfunctional quaternary ammonium compound is fixed to said solid in a layer having a thickness of up to about 100$\mu$.

12. A process as in claim 1 wherein said soil-collecting polyfunctional quaternary ammonium compound is present on a finely divided solid having a surface area of at least about 0.5 $m^2/g$.

13. A process as in claim 1 including adding to said wash bath finely-divided solids which have been provided with a hydrophobic surface finish or contain hydrophobic molecular fractions.

14. A process as in claim 13 wherein said solids are selected from the group consisting of a silica, a surfactant which has poor solubility in said wash bath and mixtures thereof.

15. A process as in claim 14 including adding to said wash bath a surfactant which is soluble in said wash bath.

16. A process as in claim 1 wherein said ultrasound treatment is performed at a wash bath temperature of up to about 80° C.

17. A process as in claim 1 wherein said ultrasound treatment is performed at a frequency of up to about 100 kHz.

18. A process as in claim 1 wherein said ultrasound treatment is performed with static and/or sliding frequencies by continuous and/or pulsating sound exposure.

19. A process as in claim 18 wherein said sound exposure is performed at a power density of up to about 50 $W/cm^2$.

20. A process as in claim 1 including replacing said soil-collecting polyfunctional ammonium compound either continuously or intermittently.

21. A process as in claim 1 including passing said wash bath and said soil-collecting polyfunctional quaternary ammonium compound into a separation zone wherein at least a portion of said soil-collecting compound is removed from said wash bath.

22. A process as in claim 1 including contacting said wash bath with said soil-collecting polyfunctional quaternary ammonium compound until from about 20 to about 95% of the soil-collecting capacity of said soil-collecting compound is exhausted.

23. A process as in claim 1 including replacing said soil-collecting polyfunctional ammonium compound either continuously or intermittently and passing said article in said wash bath either continuously or intermittently.

24. A process as in claim 1 wherein said soil-collecting quaternary ammonium compound is separated from said article to be cleaned, said wash bath is conducted continuously or intermittently over said soil-collecting compound, and said wash bath is returned to said cleaning process.

25. A process for cleaning a soiled solid molded article containing a pigmented or fatty soil comprising treating said article in an aqueous detergent wash bath in the presence of ultrasound whereby said pigmented or fatty soil is loosened from said soiled article, and collecting from said wash bath at least a portion of said soils loosened from said article by contacting said wash bath with (a) a soil-collecting polyfunctional quaternary ammonium compound which is at least substantially insoluble in said wash bath, said solid comprising a particulate, finely-divided material having an average particle size of up to about 100 microns, and (b) a heterogeneous solid having a high absorption capacity for oleophilic soil.

* * * * *